US011331921B2

(12) United States Patent
Provenaz

(10) Patent No.: US 11,331,921 B2
(45) Date of Patent: May 17, 2022

(54) FACILITY FOR APPLYING A COATING PRODUCT AND METHOD FOR CLEANING SUCH A FACILITY

(71) Applicant: EXEL INDUSTRIES, Epernay (FR)

(72) Inventor: Philippe Provenaz, Paris (FR)

(73) Assignee: EXEL INDUSTRIES, Epernay (FR)

( * ) Notice: Subject to any disclaimer, the term of this patent is extended or adjusted under 35 U.S.C. 154(b) by 0 days.

(21) Appl. No.: 16/847,055

(22) Filed: Apr. 13, 2020

(65) Prior Publication Data

US 2020/0324549 A1 Oct. 15, 2020

(30) Foreign Application Priority Data

Apr. 15, 2019 (FR) ..... 1903999

(51) Int. Cl.
*B05B 15/531* (2018.01)
*B41J 2/165* (2006.01)
*B05B 1/16* (2006.01)

(52) U.S. Cl.
CPC ..... *B41J 2/16552* (2013.01); *B05B 1/16* (2013.01); *B05B 15/531* (2018.02); *B41J 2/16588* (2013.01)

(58) Field of Classification Search
CPC ..... B41J 2/16554; B41J 2/16588; B41J 2/16552; B05B 15/531; B05B 1/16
See application file for complete search history.

(56) References Cited

U.S. PATENT DOCUMENTS 6,183,058 B1 * 2/2001 Sharma ..... B41J 2/16552 347/25
2019/0337006 A1 11/2019 Fritz et al.

FOREIGN PATENT DOCUMENTS

EP 0995606 A2 4/2000
WO 2018108568 A1 6/2018

OTHER PUBLICATIONS

INPI Rapport de Recherche Preliminaire for Patent Application No. FR 1903999, Dec. 20, 2019, 2 pp.

* cited by examiner

*Primary Examiner* — Sharon Polk
(74) *Attorney, Agent, or Firm* — Soquel Group, LLC

(57) ABSTRACT

A facility for applying a coating product including a set of printing nozzles, each nozzle including an outlet channel emerging in the downstream direction by a coating product discharge orifice, the facility further including a cleaning station for at least one nozzle of the set of printing nozzles, the station including at least one cleaning fluid injector in the outlet channel of the printing nozzle, through its discharge orifice.

20 Claims, 6 Drawing Sheets

FACILITY FOR APPLYING A COATING PRODUCT AND METHOD FOR CLEANING SUCH A FACILITY

CROSS-REFERENCE TO RELATED APPLICATION

This application claims priority of French Patent Application No. 19 03999, filed on Apr. 15, 2019.

FIELD OF THE INVENTION

The present invention relates to a facility for applying a coating product comprising a set of nozzles each including an outlet channel emerging in the downstream direction by a coating product discharge orifice.

BACKGROUND OF THE INVENTION

The demand for customization of the decoration affixed on objects is tending to increase substantially. For example, the coating of dual-tone motor vehicle bodies is becoming increasingly frequent. Furthermore, the production of patterns, with a specific geometry, is potentially of interest for certain other markets. In this context, the coating industry has recently explored solutions consisting of "printing" paint, using printheads, rather than spraying it, using sprayers.

The current printheads are configured to work with very low-viscosity inks, in particular less than 20 milliPascal-second (mPas), containing very small particles, on the submicron scale. In order to apply a coating product, such as paint, using a printing technique, printing nozzles must be used, which have a paint discharge orifice with a small diameter, typically in the order of 150 to 200 micrometers (μm), which is much smaller than the diameters of an outlet orifice of a sprayer, which are generally greater than 800 μm. In the field of printing with inks, the color of the layer of ink applied results from the combination of four base colors, namely cyan, magenta, yellow and black. However, in the field of paint, the color of the applied layer is defined by pigments dispersed in the paint.

For reasons of economy and practicality, a same applicator, which generally comprises several nozzles, is generally used to apply paints of different colors, which involves cleaning each nozzle during a change of coating product, that is to say, a change of color.

In the case of the application of paint using a printing technique, in light of the small dimensions of the outlet orifices of the nozzle, there is a risk of these nozzles becoming plugged because the known cleaning techniques, which for the most part consist of circulating a cleaning liquid after the paint in each of the nozzles, do not allow effective cleaning of the outlet channel of each nozzle, in particular of its cleaning product discharge orifice. This results in a risk of mixing of the paints used successively in a set of nozzles.

Furthermore, it is known from WO-A-2018/108568 to rinse the nozzles individually, which is time-consuming and difficult to apply in practice.

SUMMARY OF THE DESCRIPTION

The invention aims more specifically to address these drawbacks by proposing a new facility for applying a coating product that comprises printing nozzles and that can be cleaned easily.

To that end, the invention relates to a facility for applying a coating product including a set of printing nozzles each including an outlet channel emerging in the downstream direction by a coating product discharge orifice. According to the invention, the facility further includes several injectors provided to simultaneously clean several nozzles of a row of nozzles or all of the nozzles of the set of nozzles, by injecting cleaning fluid into the outlet channels of the printing nozzles of the row or the set of nozzles, through their discharge orifices.

Owing to the invention, simultaneous cleaning of the downstream part of several printing nozzles, i.e., of their outlet duct and their discharge orifice, may be performed in the direction opposite the normal flow direction of the coating product in each nozzle, defined as the flow direction of the coating product during the application. This cleaning is particularly effective and not time-consuming, inasmuch as it can be simultaneous for a large number of nozzles of the set of printing nozzles, for example for all of the nozzles of a row of nozzles in the case of an arrangement of the nozzles in a matrix.

According to advantageous but optional aspects of the invention, such a facility may incorporate one or more of the following features, considered in any technically allowable combination:

- The cleaning station is equipped with one or several sealing gaskets making it possible to isolate each discharge orifice of a printing nozzle with respect to the outside, when the set of printing nozzles bears against the cleaning station.
- The sealing gasket(s) individually isolate each discharge orifice with respect to the outside, when the set of printing nozzles bears against the cleaning station.
- The cleaning station includes members for cleaning a front face of at least one printing nozzle, preferably each printing nozzle.
- The nozzles of the set of printing nozzles protrude from a front face of this assembly and the cleaning station comprises housings for at least partially receiving printing nozzles, when the front face of the set of nozzles is across from, or bearing against, an upper or side face of the cleaning station in which the housings emerge, when a cleaning fluid injector emerges in each housing.
- The outlet orifices of the printing nozzles are flush with a front face of the set of printing nozzles, while the cleaning station comprises an upper or side face in which the cleaning fluid injectors emerge and, when the front face of the set of printing nozzles bears against the upper or side face of the cleaning station, the discharge orifices of the printing nozzles are each aligned with an injector of the cleaning station.
- The cleaning station includes a body inside which cleaning fluid circulation channels are arranged, while the injectors are arranged in this body, downstream from these channels.
- The facility further includes a multiaxial robot making it possible to move the set of printing nozzles between a spraying position, where the set of printing nozzles is oriented toward an object to be coated, and a cleaning position, where the set of printing nozzles is in contact with the cleaning station.
- Each printing nozzle has a printhead and its discharge orifice has an inner diameter of between 50 and 300 μm, preferably between 100 and 200 μm, still more preferably in the order of 150 μm.

The ratio between the inner diameter of the discharge orifice of a nozzle and the diameter of an injector is between 0.03 and 0.5, preferably between 0.05 and 0.2.

The printing nozzles of the set of printing nozzles are positioned in at least one row and the injectors of the cleaning station are positioned in the same number of row(s), the spacing between two adjacent injectors of a row of injectors being the same as the spacing between two adjacent printing nozzles of a row of printing nozzles.

The set of nozzles is equipped with a first bleed valve and the cleaning station is equipped with a second bleed valve, each of these bleed valves making it possible to discharge the cleaning fluid after use.

According to a second aspect, the invention relates to a method for cleaning a set of printing nozzles of a facility as mentioned above, i.e., a facility for applying coating product where each printing nozzle also includes an outlet channel emerging in the downstream direction by a coating product discharge orifice. According to the invention, this method includes at least one operation of:

a) simultaneously injecting a cleaning fluid into the outlet channel of several printing nozzles, through their discharge orifices.

This method makes it possible to achieve the same advantages as the facility of the invention.

Advantageously, the inventive method includes at least one additional operation of:

b) orienting a flow of cleaning fluid toward a front face of each printing nozzle, on which the discharge orifice of the printing nozzle is arranged.

According to another advantageous aspect, it is possible to provide that the method includes at least operations, prior to operation a), and if applicable, to operation b), of:

y) moving the set of printing nozzles from a spraying position, where the set of printing nozzles is oriented toward an object to be coated, toward a cleaning pre-position, where the set of printing nozzles is across from a cleaning station, and z) bringing the set of printing nozzles to bear tightly against the cleaning station, in a configuration where the discharge orifice of each printing nozzle is aligned on a cleaning fluid injector belonging to the cleaning station.

According to another advantageous aspect of the invention, an additional operation may be provided, of:

c) injecting, in each printing nozzle, a cleaning fluid in a direction going from a supply duct, which is part of the set of printing nozzles, toward the discharge orifice, while passing through the outlet channel.

BRIEF DESCRIPTION OF THE DRAWINGS

The invention will be better understood and other advantages thereof will appear more clearly in light of the following description of three embodiments of a facility and a method according to its principle, provided solely as an example and done in reference to the appended drawings, in which.

DETAILED DESCRIPTION

Figure 1:
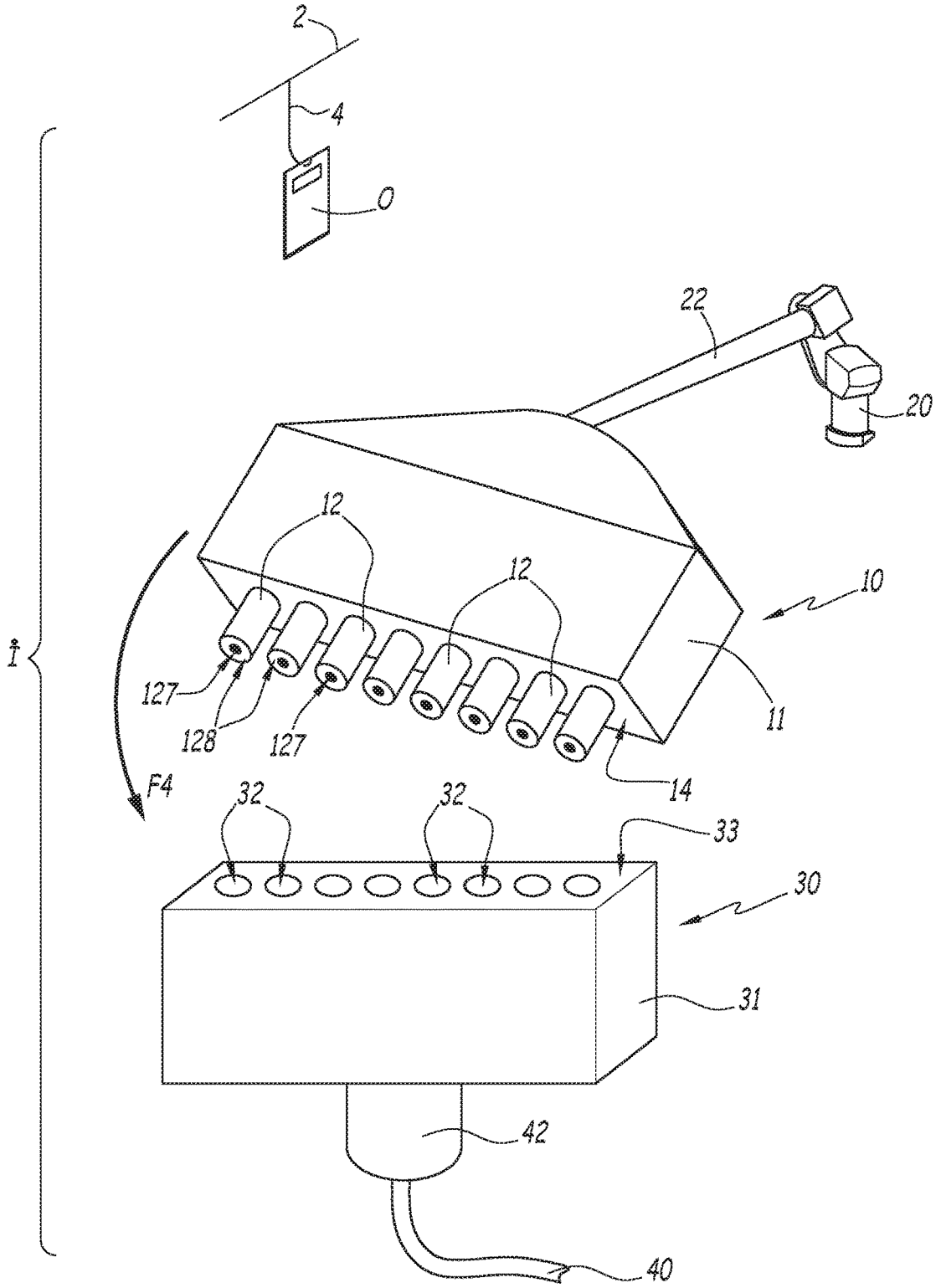
FIG. 1 is a schematic illustration of a facility according to the invention.
Figure 2:
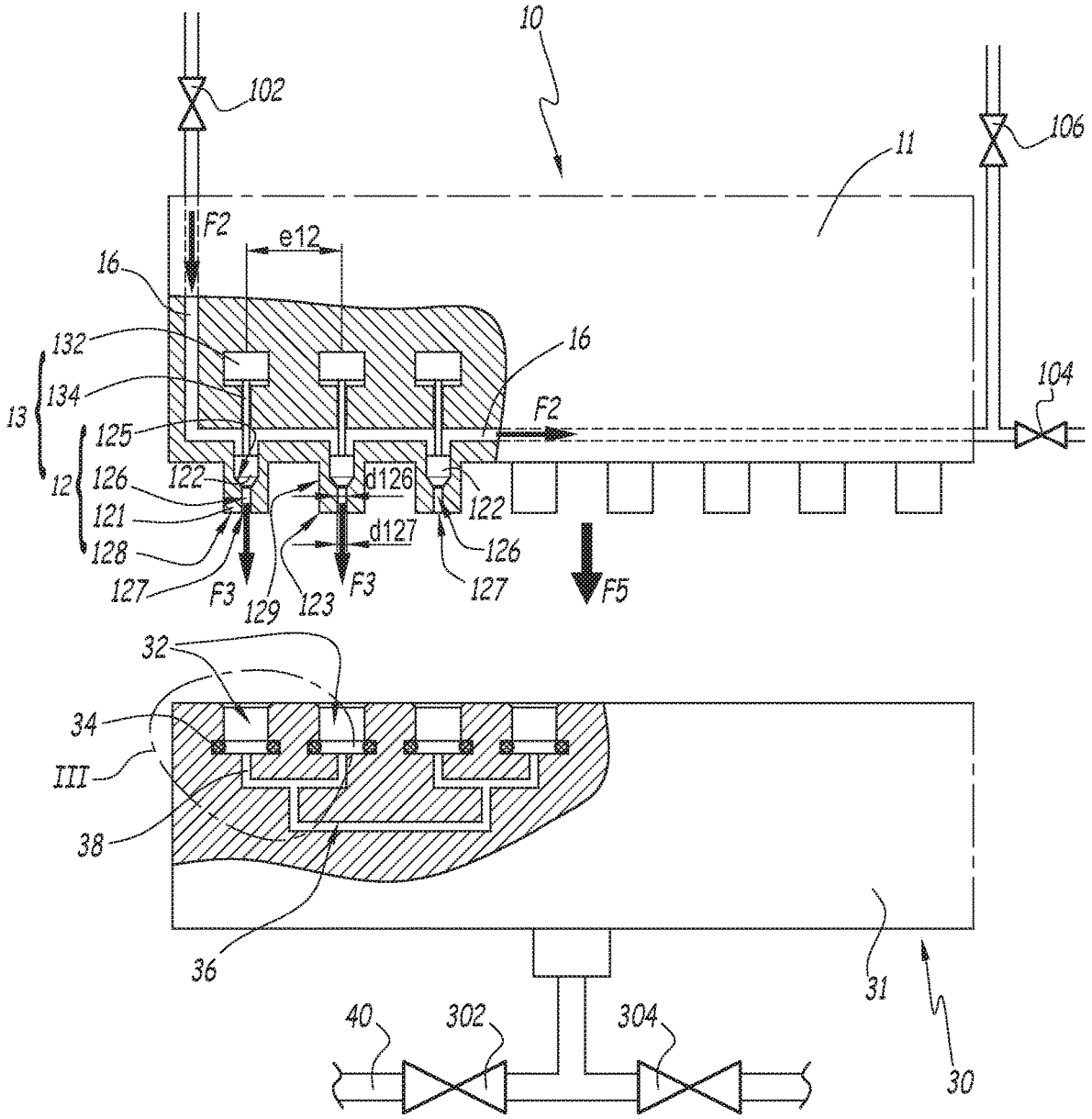
FIG. 2 is a partial cross-sectional diagram of a set of nozzles and a cleaning station belonging to the facility of FIG. 1.
Figure 3:
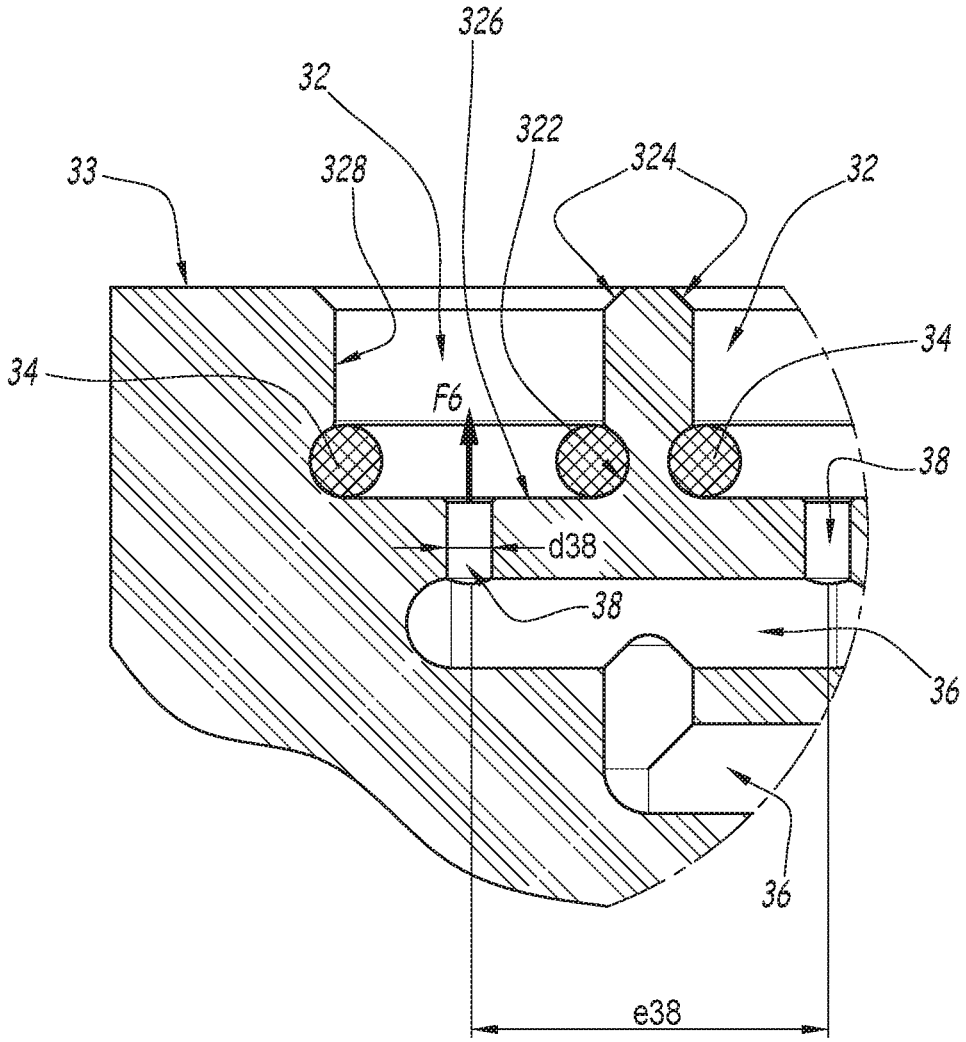
FIG. 3 is an enlarged view of detail III in FIG. 2.

The facility I shown in FIGS. 1-3 is provided for the application of paint on objects O moved by a conveyor 2 from which objects O are suspended by hooks 4.

In the example of the figures, objects O are globally flat panels. In a variant, it may involve motor vehicle body parts or whole motor vehicle bodies moved by a conveyor of the stop-and-go or continuous forward movement type.

The facility I includes a set 10 of nozzles that is mounted at the end of an arm 22 of a multiaxial robot 20 positioned near conveyor 2.

In FIG. 1, the perspective effect is exaggerated, so as to reduce the size of the illustration of robot 20, which is known in itself.

Set 10 of nozzles includes eight nozzles 12 positioned in a row and that each project from a front face 14 of set 10 of nozzles, the front face being oriented toward an object to be painted, O, when nozzles 12 are used to apply paint.

As emerges from FIG. 2, each nozzle 12 belongs to a printhead 13 that further includes a control member 132, for example, of the piezoelectric component type, and a rod 134. Each nozzle 12 includes a needle 122, controlled by control member 132 of printhead 13 to which the nozzle belongs and coupled to the latter by rod 134.

The paint to be applied flows in a channel 16, arranged in a body 11 of set 10 of nozzles, and circulates in the direction of arrows F2 in FIG. 2.

According to one aspect of the invention shown only in FIG. 2, set 10 of nozzles is equipped with a supply valve 102, a bleed valve 104 and a recirculation valve 106. Bleed valve 104 is provided to control the discharge of cleaning fluid toward a collector, not shown, after use during a cleaning circuit. In this figure, valves 102, 104 and 106 are shown outside of body 11. In practice, they can be integrated into this body, which explains why they are not visible in FIG. 1.

Reference 121 denotes the part of a nozzle 12 that protrudes from front face 14.

Inside part 121 of a nozzle 12, a seat 125 is arranged against which needle 122 of the nozzle bears selectively, being controlled by component 132.

An outlet channel 126 is arranged in each nozzle 12, downstream from its needle 122. Outlet channel 126 emerges toward the outside, opposite needle 122, via a discharge orifice 127 arranged in a front face 128 of nozzle 12, more specifically in front face 128 of its part 121.

In a variant, a different structure may be considered for nozzles 12, which are advantageously identical to one another, as long as they include an outlet channel 126 and a discharge orifice 127.

The facility I also includes a cleaning station 30 that is supplied with cleaning fluid by a hose 40, connected to station 30 using a coupler 42 that constitutes the downstream end of hose 40.

Cleaning station 30 is located in the booth where paint is applied, in an area reachable by multiaxial robot 20.

Cleaning station 30 includes a body 31 in which eight housings 32 are positioned in a row and configured each to receive, in part or in whole, part 121 of a nozzle 12.

At the junction between bottom 326 and circular wall 328 of each housing 32, a groove 322 is provided, in which a sealing gasket 34 is housed that is preferably of the O-ring type and made from elastomer.

Channels 36 are arranged in body 31 and make it possible to convey the cleaning fluid coming from hose 40 into each of housings 32. More specifically, set of channels 36 emerges in each housing 32 by an injector 38, advantageously formed by a channel with diameter d38 smaller than that of channels 36. This makes it possible to distribute the cleaning fluid flow rates identically toward the various injectors 38, by arranging progressive head losses on the flow paths of this fluid in channels 36, which prevents preferred flow paths.

According to one aspect of the invention shown only in FIG. 2, cleaning station 30 is equipped with a supply valve 302 and a bleed valve 304. Bleed valve 304 is provided to control the discharge of cleaning fluid toward a collector, not shown, after use during a cleaning circuit. In this figure, valves 302 and 304 are shown outside of body 31. In practice, they can be integrated into this body, which explains why they are not visible in FIG. 1.

The cleaning fluid passing through hose 40, channels 36 and injectors 38 may be a cleaning fluid, containing solvent or water-soluble as a function of the nature of the paint applied with nozzles 12, or a gas, in particular air, or a mixture of liquid and gas.

Each housing 32 emerges on upper face 33 of station 30 by a bevel 324, which contributes to guiding parts 121 during their simultaneous introduction into housings 32, as emerges from the following explanations.

During the application of paint on the objects O, set 10 of nozzles is oriented toward one of these objects and nozzles 12 are supplied with coating product through channels 16. Supply valve 102 and recirculation valve 106 are open, while bleed valve 104 is closed. Each needle 122 may be controlled individually by component 132 associated with printhead 13, to be selectively moved away from corresponding seat 125. This makes it possible to supply, or not supply, outlet channel 126 of each nozzle 12 with paint. When this is the case, the paint flows in the direction of arrows F3 of FIG. 2 and emerges from the corresponding nozzle 12 by its discharge orifice 127, toward the object O being coated.

Arrows F3 therefore show the normal direction of flow of the paint being applied on an object O.

During an application phase, when nozzles 12 need to be cleaned, for example, due to a change of paint color, set 10 of nozzles is moved by multiaxial robot 20, to pre-position it above cleaning station 30, by positioning front face 14 above, and parallel with, upper face 33, as shown by arrow F4 in FIG. 1.

Next, set 10 of nozzles is made to bear tightly against cleaning station 30, by introducing each part 121 of a nozzle 12 into a housing 32, in the direction of arrow F5 in FIG. 2.

The geometry of parts 121, on the one hand, and orifices 32, on the other hand, is such that, at the end of the movement along arrow F5, discharge orifice 127 of each nozzle 12 is aligned on an injector 38 of station 30.

It is then possible to supply ducts 36 with cleaning fluid, by actuating a booster pump of hose 40 or another supply means thereof, supply valve 302 being open and bleed valve 304 being closed, such that cleaning fluid leaves each injector 38, in the direction of arrow F6 in FIG. 3, and penetrates outlet channel 126 of nozzle 12, part 121 of which is positioned in housing 32, by passing through its discharge orifice 127, i.e., in the direction opposite the normal flow direction of the paint in the nozzles, during application, this normal direction being shown by arrows F3, as indicated above.

Nozzles 12 engaged in housings 32 are thus cleaned simultaneously. The cleaning fluid that penetrates each outlet duct 126 may rise to needle 122 and seat 125 of the nozzle, which it also cleans. This flow in the opposite direction in nozzles 12 is possible because bleed valve 104 is open, while supply valve 102 and recirculation valve 106 are closed.

Reference 123 denotes a junction rim between front face 128 of a nozzle 12 and peripheral surface 129 of its part 121. In the injection configuration of the cleaning fluid into outlet channels 126 through respective discharge orifices 127 of the various nozzles 12, junction rim 123 bears against corresponding seal 34, which thus isolates front face 128 from the outside. Thus, each discharge orifice 127 and each front surface 128 are individually isolated from the outside by a seal 34.

As a result, the flow of cleaning fluid leaving an injector 38 is distributed against front face 128 of corresponding nozzle 12, which contributes to the cleaning of this front face. Thus, injectors 38 constitute both cleaning members for the inner parts of nozzles 12, formed by needles 122, seats 125 and channels 126, and cleaning members for front faces 128 of the nozzles.

Figure 4:
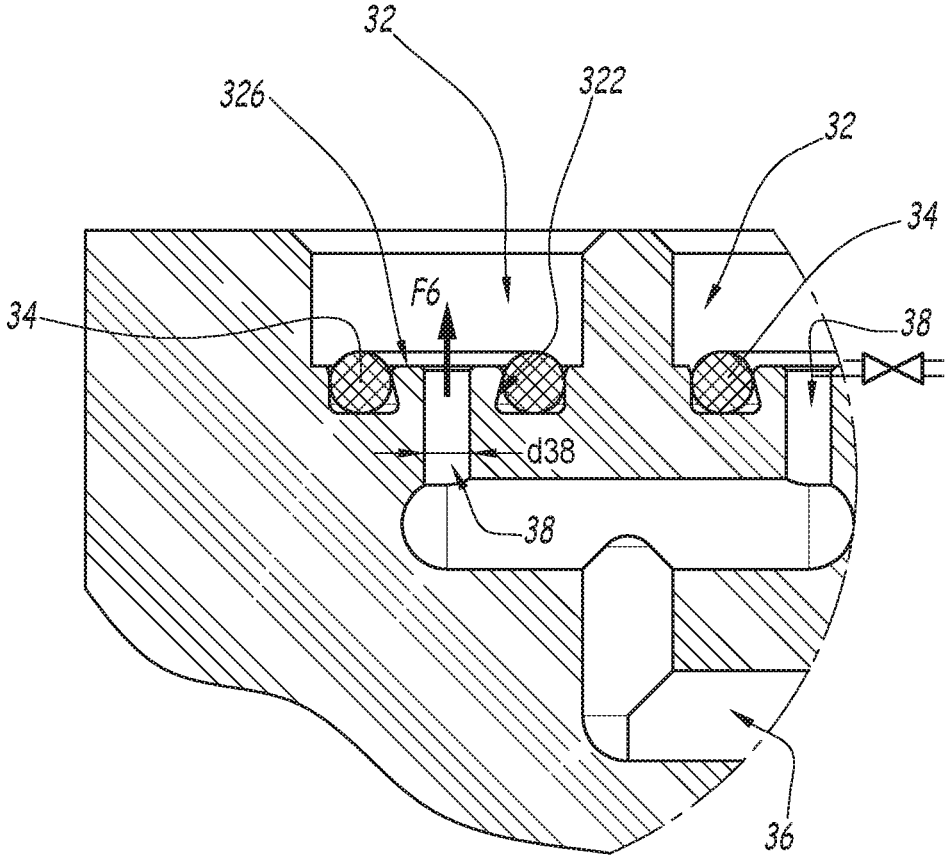
FIG. 4 is a view similar to FIG. 3, for a facility according to a second embodiment of the invention.
Figure 5:
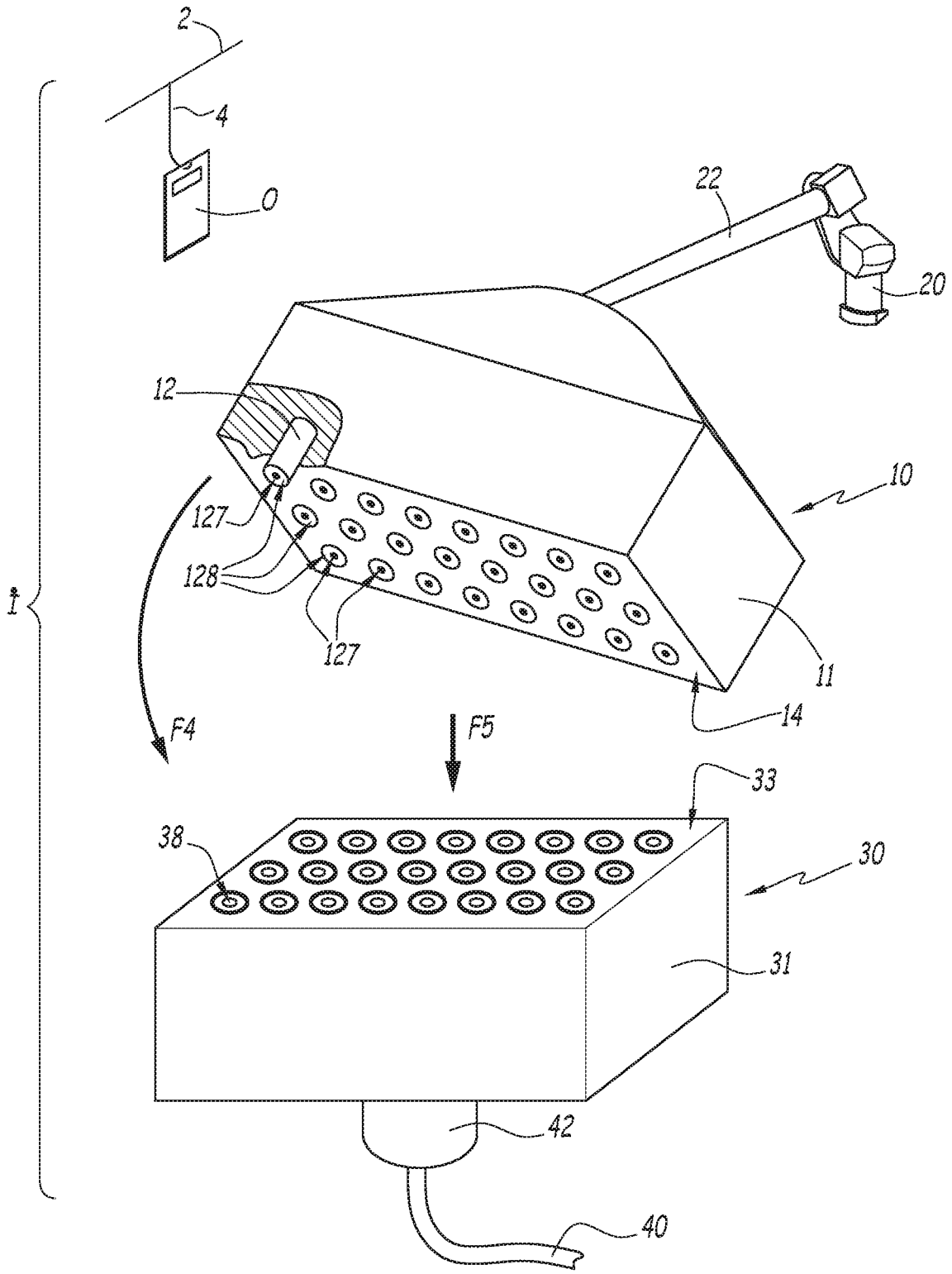
FIG. 5 is a view similar to FIG. 1 for a facility according to a third embodiment of the invention.
Figure 6:
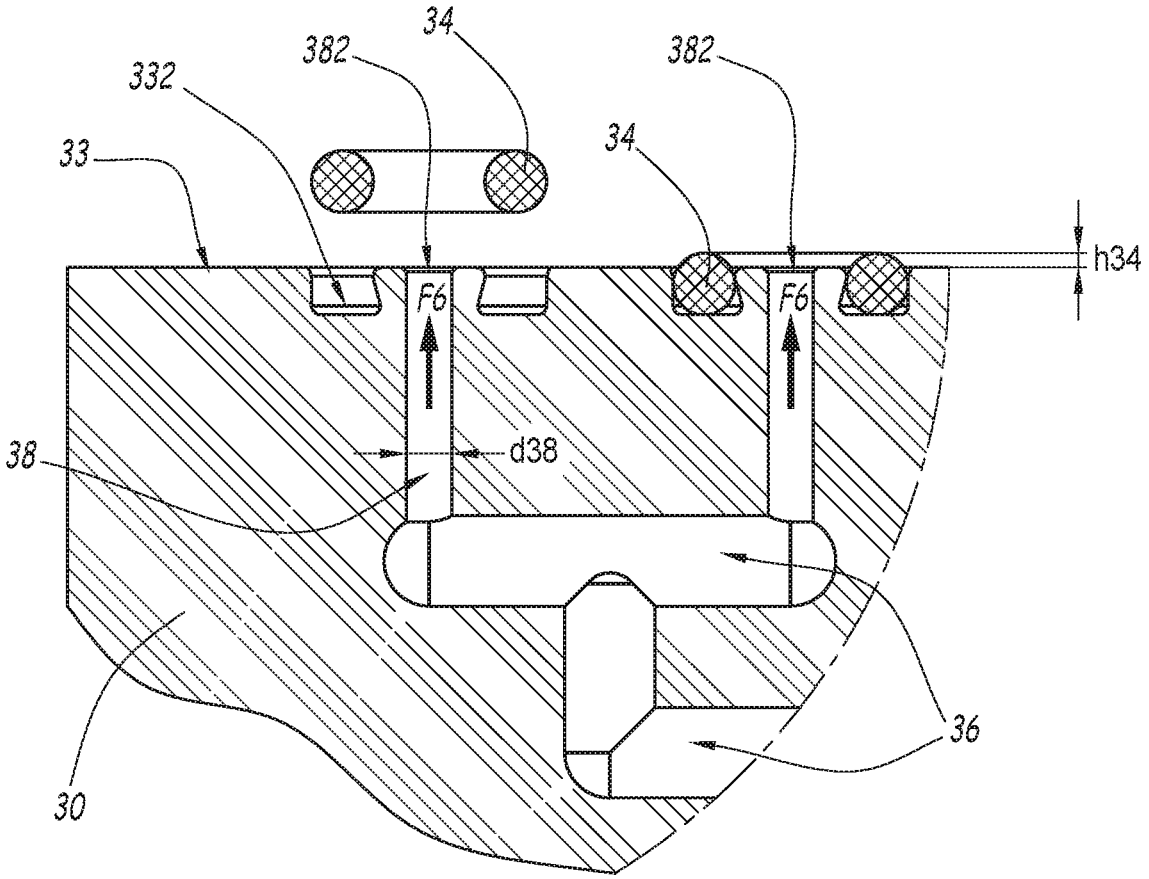
FIG. 6 is a view similar to FIG. 3 for the facility of FIG. 5.

In the second and third embodiments of the invention shown in FIGS. 4-6, the elements similar to those of the first embodiment bear the same references. Hereinafter, we primarily describe the differences between these second and third embodiments and the previous one.

In the second embodiment shown in FIG. 4, O-ring 34 is positioned in a groove 322 arranged not at the junction between the bottom and the side of the housing 32, but in bottom 326 of this housing, such that seal 34 fluidly isolates a smaller part of front face 128 of nozzle 12, part 121 of which is positioned in housing 32.

In the third embodiment shown in FIGS. 5 and 6, set 10 of nozzles includes three rows of eight nozzles 12, front faces 128 of which are flush with front face 14 of set 10 of nozzles. Discharge orifices 127 of the various nozzles 12 are thus distributed on front face 14.

In FIG. 5, only one nozzle 12 is shown, by cutaway. Each nozzle 12 belongs to a printhead, not shown, which is of the type of printhead 13 of the first embodiment.

Cleaning station 30 is also supplied by a hose 40 and its downstream coupler 42 and includes twenty-four injectors 38 that are distributed in three rows of eight injectors.

The various injectors 38 emerge directly in upper face 33 of body 31 of station 30. In other words, in this embodiment, no housing is provided that is comparable to housings 32 of the first and second embodiments.

Outlet orifice 382 of each injector 38, which is located in upper face 33, is surrounded by a groove 332 arranged in upper face 33 of body 31 and in which an O-ring 34 is arranged. The depth of groove 332 and the toroid diameter of seal 34 are chosen such that, when it is in place in groove 332, O-ring 34 protrudes from groove 332 over a height h34 of between 0.1 and 0.5 mm. Thus, when nozzles 12 need to be cleaned after a paint application phase, set 10 of nozzles is moved, in the direction of arrow F4 in FIG. 5, to bring it into the cleaning pre-position, with its front face 34 across from upper surface 33 of cleaning station 30. Then, set 10 of nozzles is brought to bear tightly against the various seals 34, by a movement in the direction of arrow F5 in FIG. 5.

In this case as well, each discharge orifice 127 and each front face 128 are individually isolated from the outside by a seal 34.

It is then possible to inject cleaning fluid into the various outlet channels 126 of nozzles 12, through their outlet orifices 127, by supplying injectors 38 with cleaning fluid, which makes it possible to circulate this cleaning fluid in the direction of arrows F6 in FIG. 6, to the inside of outlet channels 126 of nozzles 12, toward the needles and the seats of these nozzles. In light of the positioning of seals 34, this also makes it possible to clean front faces 128 of nozzles 12.

In the second and third embodiments, supply, bleed and recirculation valves, not shown, are provided, as in the first embodiment.

In practice, irrespective of the embodiment, diameter d38 of injectors 38 is adapted to diameter d126 of outlet channels 126 and diameter d127 of discharge orifices 127. Diameters d126 and d127 may be equal. As an example, these diameters are between 50 μm and 300 μm, preferably between 100 μm and 200 μm, still more preferably on the order of 150 μm. In this case, diameter d38 of injectors 38 may be between 0.5 mm and 2 mm, preferably on the order of 1 mm. Advantageously, irrespective of the embodiment, the ratio d126/d38 and/or the ratio d127/d38 is between 0.03 and 0.5, preferably between 0.05 and 0.2.

The invention is described above in the case where the product applied using nozzles 12 is paint. Other coating products can be applied with a facility according to the invention, in particular a primer or a varnish.

The invention is described above in the case where set 10 of nozzles docks to cleaning station 30 from above. In a variant, this docking can take place from one side of the cleaning station, in which case housings 32 or mouths 382 of injectors 38 are arranged not in upper face 33 of body 31, but in a side face of this body.

Irrespective of the embodiment, cleaning station 30 may be manufactured by three-dimensional printing, which makes it possible to adapt the distribution and the conveyance of channels 36 and injectors 38 inside the body of this cleaning station, without using a mold with slide valves or complex machining lines. However, it remains possible to manufacture the cleaning station by molding and/or machining.

The number of rows of printing nozzles 12 may be chosen, greater than or equal to one, as a function of the size of the surface to be coated of each object O, the number of rows of injectors 38 being adapted accordingly.

Reference e12 denotes the separation between two printing nozzles 12 within a row of printing nozzles, and reference e38 denotes the separation between two injectors 38 within a row of injectors. Irrespective of the embodiment, these separations e12 and e38 are chosen to be identical within two rows of nozzles and injectors intended to cooperate with one another.

According to one advantageous aspect of the invention applicable to all of the embodiments, and in order to further improve the cleaning of printing nozzles 12, it is possible to provide that, before or after the injection of cleaning fluid into outlet channels 126, through discharge orifices 127, in the direction of arrows F6, a cleaning fluid is injected into each printing nozzle in the normal flow direction of the coating product, i.e., in a direction going from supply channel 16 toward discharge orifice 127 while passing through outlet channel 126, which amounts to injecting the cleaning fluid in the direction of arrows F3 in FIG. 2. In this case, assuming that the cleaning fluid is injected into channel 16 upstream from supply valve 102, supply valve 102, bleed valve 104 and bleed valve 304 are open, while recirculation valve 106 and supply valve 302 are closed. When this optional aspect of the invention is implemented, the cleaning of injection nozzles 12 takes place successively in both directions, namely in the direction of the arrows F6, with valves 302 and 104 open and the other valves closed, and in the direction of arrows F3, with valves 102, 104 and 304 open and the other valves closed.

Irrespective of the embodiment, the addition of bleed valves 104 and 304 makes it possible to collect the cleaning fluid after use thereof to clean one or several nozzles 12, without risk of polluting the coating product or the cleaning fluid not yet used.

The invention is shown in the figures in the case where all nozzles 12 of set 10 of nozzles are cleaned simultaneously. However, this is not mandatory. The nozzles may be cleaned in groups, for example, row by row in the case of a set 10 with several rows of nozzles. In this case, the distribution of injectors 38 of cleaning station 30 is adapted, like the distribution of seals 34 and that of channels 36.

The embodiments and alternatives considered above may be combined to generate new embodiments of the invention.

The invention claimed is:

1. A facility for applying a coating product comprising:

a set of printing nozzles, each nozzle comprising an outlet channel emerging in the downstream direction by a coating product discharge orifice; and a cleaning station comprising several injectors provided to simultaneously clean several nozzles of a row of printing nozzles or all of the nozzles of said set of printing nozzles, by injecting cleaning fluid into said outlet channels of said nozzles of the row or said set of printing nozzles, through their discharge orifices.

2. The facility according to claim 1, wherein said cleaning station comprises one or more sealing gaskets to isolate each discharge orifice of a printing nozzle with respect to the outside, when said set of printing nozzles bears against said cleaning station.

3. The facility according to claim 2, wherein said sealing gasket(s) individually isolate each discharge orifice with respect to the outside, when said set of printing nozzles bears against said cleaning station.

4. The facility according to claim 1, wherein said cleaning station comprises cleaning members for cleaning a front face of at least one printing nozzle.

5. The facility according to claim 4 wherein said cleaning members clean each printing nozzle.

6. The facility according to claim 1, wherein the nozzles of said set of printing nozzles protrude from a front face of said set of printing nozzles, and said cleaning station comprises housings for at least partially receiving printing nozzles, when the front face of said set of printing nozzles is across from, or bearing against, an upper or side face of said cleaning station in which the housings emerge, and wherein a cleaning fluid injector emerges in each housing.

7. The facility according to claim 1, wherein said outlet orifices of said printing nozzles are flush with a front face of said set of printing nozzles, wherein said cleaning station comprises an upper face or side face in which the cleaning fluid injectors emerge and wherein, when the front face of said set of printing nozzles bears against said upper face or said side face of said cleaning station, the discharge orifices of said printing nozzles are each aligned with an injector of said cleaning station.

8. The facility according to claim 1, wherein said cleaning station comprises a body inside which cleaning fluid circulation channels are arranged, and wherein said injector(s) are arranged in said body, downstream from the channels.

9. The facility according to claim 1, further comprising a multiaxial robot to move said set of printing nozzles between a spraying position, where said set of printing nozzles is oriented toward an object to be coated, and a cleaning position, where said set of printing nozzles is in contact with said cleaning station.

10. The facility according to claim 1, wherein each printing nozzle has a printhead and its discharge orifice has an inner diameter of between 50 and 300 μm.

11. The facility according to claim 10, wherein the inner diameter of each discharge orifice is between 100 and 200 μm.

12. The facility according to claim 11, wherein the inner diameter of each discharge orifice is on the order of 150 μm.

13. The facility according to claim 1, wherein the ratio between the inner diameter of the discharge orifice of a nozzle and the diameter of an injector is between 0.03 and 0.5.

14. The facility according to claim 13, wherein the ratio is between 0.05 and 0.2.

15. The facility according to claim 1, wherein the nozzles of said set of printing nozzles are positioned in at least one row and said injectors of said cleaning station are positioned in the same number of row(s), the spacing between two adjacent injectors of a row of injectors being the same as the spacing between two adjacent printing nozzles of a row of printing nozzles.

16. The facility according to claim 1, wherein said set of printing nozzles is equipped with a first bleed valve, and said cleaning station is equipped with a second bleed valve, each of the bleed valves discharging the cleaning fluid after use.

17. A method for cleaning a set of printing nozzles of a facility for applying coating product, each printing nozzle comprising an outlet channel emerging in the downstream direction by a coating product discharge orifice, the method comprising simultaneously injecting, via several injectors, a cleaning fluid into the outlet channel of several printing nozzles of one row or all of the nozzles of the set of nozzles, through their discharge orifices.

18. The method according to claim 17 further comprising orienting a flow of cleaning fluid toward a front face of each printing nozzle, on which the discharge orifice of the printing nozzle is arranged.

19. The method according to claim 17 further comprising, prior to said simultaneously injecting:

moving the set of printing nozzles from a spraying position, where the set of printing nozzles is oriented toward an object to be coated, toward a cleaning pre-position, where the set of printing nozzles is across from a cleaning station; and bringing the set of printing nozzles to bear tightly against the cleaning station, in a configuration where the discharge orifice of each printing nozzle is aligned on a cleaning fluid injector belonging to the cleaning station.

20. The method according to claim 17 further comprising injecting, in each printing nozzle, a cleaning fluid in a direction going from a supply duct, which is part of said set of printing nozzles, toward the discharge orifice, while passing through said outlet channel.

* * * * *